US005894960A

United States Patent [19]

Rodden, Jr. et al.

[11] Patent Number: 5,894,960

[45] Date of Patent: Apr. 20, 1999

[54] PUMP MECHANISM FOR MECHANICAL DISPENSERS

[75] Inventors: Edward J. Rodden, Jr.; Randy F. Reeve, both of Upland, Calif.

[73] Assignee: 3D Design and Engineering, Upland, Calif.

[21] Appl. No.: 08/841,257

[22] Filed: Apr. 29, 1997

[51] Int. Cl.[6] ..... B65D 37/00

[52] U.S. Cl. ..... 222/207; 222/209; 222/383.1; 222/481.5

[58] Field of Search ..... 222/207, 209, 222/341, 383.1, 481.5

[56] References Cited

U.S. PATENT DOCUMENTS

| | | | |
|---|---|---|---|
| 1,992,518 | 2/1935 | Werner | 222/207 |
| 2,824,672 | 2/1958 | Wersching | 222/207 |
| 3,749,290 | 7/1973 | Micallef | 222/213 |
| 3,973,700 | 8/1976 | Schmidt et al. | 222/153 |
| 3,986,644 | 10/1976 | Grogan et al. | 222/207 |
| 3,995,776 | 12/1976 | Micallef | 222/207 |
| 4,101,057 | 7/1978 | LoMaglio | 222/207 |
| 4,155,487 | 5/1979 | Blake | 222/207 |
| 4,201,317 | 5/1980 | Aleff | 222/207 |
| 4,216,882 | 8/1980 | Basile et al. | 222/207 |
| 4,222,501 | 9/1980 | Hammett et al. | 222/207 |
| 4,225,061 | 9/1980 | Blake et al. | 222/207 |
| 4,260,079 | 4/1981 | Cary et al. | 222/209 |
| 4,336,895 | 6/1982 | Aleff | 222/207 |
| 4,489,861 | 12/1984 | Saito et al. | 222/207 |
| 4,880,161 | 11/1989 | Wright | 222/209 |
| 4,898,307 | 2/1990 | Tiramani | 222/207 |
| 5,238,156 | 8/1993 | Andris | 222/207 |
| 5,289,948 | 3/1994 | Moss et al. | 222/135 |
| 5,303,851 | 4/1994 | Libit et al. | 222/207 |
| 5,303,867 | 4/1994 | Peterson | 239/333 |
| 5,425,482 | 6/1995 | Foster et al. | 222/207 |
| 5,476,195 | 12/1995 | Oder et al. | 222/207 |
| 5,482,187 | 1/1996 | Poulsen et al. | 222/207 |

*Primary Examiner*—Joseph A. Kaufman
*Attorney, Agent, or Firm*—Hovey, Williams, Timmons & Collins

[57] ABSTRACT

A non-aerosol fluid dispenser includes a pump defining a fluid chamber associated with the fluid path extending between the container and fluid outlet. The pump comprises a base presenting a chamber opening, a generally non-deformable panel, a hinge about which the panel swings relative to the base, and a hollow, collapsible bellow section extending between the panel and the base. The dispenser includes a boss sealingly received within the chamber opening, with the fluid path extending through the boss and into the chamber between the supply and discharge valves. Accordingly, when the panel is swung toward the base, the bellows section uniformly collapses, whereby positive pressure created within the chamber closes the supply valve and opens the discharge valve for discharging fluid through the dispenser outlet. When the panel is released, the bellows section resiliently expands, whereby negative pressure created within the chamber opens the supply valve and closes the discharge valve for inducing fluid flow from the container into the chamber.

37 Claims, 4 Drawing Sheets

PUMP MECHANISM FOR MECHANICAL DISPENSERS

BACKGROUND OF THE INVENTION

1. Field of the Invention

The present invention relates generally to non-aerosol fluid dispensers, such as trigger sprayers. More particularly, the invention concerns a highly efficient pump for such dispensers, wherein the pump provides consistent discharge amounts and may be formed of the same material as the other dispenser components for facilitating recycling.

2. Discussion of the Prior Art

Non-aerosol fluid dispensers (or so-called "mechanical sprayers") have numerous and various applications, such as trigger sprayers for spraying liquid cleaning solutions, perfume sprayers, lotion dispensers, etc. The rising popularity of such dispensers may be attributed to several factors. For example, environmental concerns surrounding aerosol sprayers have steered development toward mechanical sprayers that eliminate the need of aerosol or gas charged containers. Further, developments in mechanical sprayer designs have increased the discharge amount and duration and allow the operator to vary the spray pattern.

Conventional mechanical sprayers include a variety of features that have become common and well-known in the industry. For example, pressure-responsive supply and discharge valves are spaced along a fluid path extending between a container and a fluid outlet. A pump defining a collapsible fluid chamber is associated with the fluid path between the valves so that the supply valve is located between the chamber and the container, and the discharge valve is located between the chamber and outlet. Accordingly, positive pressure produced when the chamber collapses causes the supply valve to close and the discharge valve to open so that fluid is dispensed through the outlet. Conversely, negative pressure produced when the chamber expands causes the supply valve to open and the discharge valve to close so that the chamber is primed with fluid from the container. As noted above, the present invention is primarily concerned with the pump and the problems associated with the various conventional pump constructions exemplified hereinbelow.

One of the most common pumps used in mechanical sprayers comprises a piston slidably disposed within a cylindrically-shaped, hollow accumulator. The piston and accumulator cooperatively define a chamber that collapses and expands as the piston is slid back-and-forth within the accumulator. A metal spring is typically disposed within the chamber for yieldably biasing the piston away from one end of the accumulator. Accordingly, fluid is discharged when the piston is manually slid toward the one end of the accumulator, and the accumulator is primed when the piston is released so that the spring slides the piston away from the one end. The piston and accumulator sealingly engage one another to prevent leakage during operation of the dispenser. Further, the piston and accumulator are formed of dissimilar materials, such as polyethylene and polypropylene, so as to allow sealed yet slidable interengagement therebetween.

The accumulator-type pump presents several problems. For example, the accumulator, piston and spring must be separately manufactured and later assembled, thereby increasing production time and costs. Additionally, recycling of the dispenser is problematic because the accumulator, piston and spring are each formed of dissimilar materials, as indicated above.

Another type of pump for mechanical sprayers comprises a resilient, hollow bulb-shaped body defining an interior fluid chamber communicating with the fluid path. Such pumps are difficult to manufacture and are often formed of expensive rubber materials. Further, collapsing of the body is often uncontrolled and therefore may vary from one operation to another, whereby the discharge amount has a tendency to be inconsistent. That is, the body has a tendency to variously flex in random amounts and directions, when it is collapsed, such that the volumetric reduction of the interior chamber varies from one operation to another.

Bellows pumps are also often used in mechanical sprayers. Conventional bellows have taken a variety of shapes, including axially collapsible bellows, "blacksmith" bellows, etc. In any case, bellows pumps often collapse in a nonuniform manner and therefore likewise present the problem of inconsistent discharge amounts. Moreover, a conventional bellows pump is not completely purged when collapsed, and consequently, air is often trapped within the fluid chamber. Because air is naturally more compressible and expandable than the dispensed fluid, the efficiency of the pump is significantly reduced. In other words, when negative or positive pressure is created within the pump chamber, the air absorbs a significant portion of the energy such that the pressure is less productive in inducing or discharging fluid into or out of the chamber. For example, as the bellows expands, the negative pressure created within the chamber not only draws fluid from the container but also causes the trapped air to expand. Furthermore, should any of the trapped air be discharged with the fluid, the highly undesirable phenomenon known as "spitting" occurs. It will be appreciated that accumulator-type and bulb-type pumps are likewise inefficient because the fluid chamber is never completely evacuated (i.e., the spring prevents evacuation of the accumulator and the bulbous body in a bulb-type pump is not depressed in a manner to completely collapse the chamber).

OBJECTS AND SUMMARY OF THE INVENTION

Responsive to these and other problems, an important object of the present invention is to provide a fluid dispenser with a pump having a simple yet effective construction. An additional important object of the present invention is to provide a highly efficient pump that produces consistent discharge amounts. Accordingly, an object of the present invention is to provide a uniformly collapsible pump that is evacuated when collapsed.

It is also an important object of the present invention to provide a pump that is formed of a single unitary body. Along these lines, another object of the present invention is to provide a pump that may be injection molded of a plastic material, such as polypropylene. Yet another object of the present invention is to provide a pump that is formed of the same material as the other dispenser components to facilitate recycling.

In accordance with these and other objects apparent from the following description of the preferred embodiments, the present invention concerns a fluid dispenser including a pump defining a fluid chamber associated with the fluid path of the dispenser between the supply and discharge valves. The pump comprises a base presenting a chamber opening, a generally non-deformable panel, a hinge about which the panel swings relative to the base, and a hollow, collapsible bellow section extending between the panel and the base. The dispenser includes a boss sealingly received within the chamber opening, with the fluid path extending through the boss and into the chamber. Accordingly, when the panel is swung toward the base, the bellows section uniformly collapses, whereby positive pressure created within the chamber closes the supply valve and opens the discharge valve for discharging fluid through the dispenser outlet. When the panel is released, the bellows section resiliently expands, whereby negative pressure created within the chamber opens the supply valve and closes the discharge valve for inducing fluid flow from the container into the chamber.

It will be appreciated that the term "non-deformable" as used herein shall be interpreted to mean that the object does not flex or distend during normal pump operation. With this in mind, the non-deformable panel may be directly acted upon to collapse the bellows section. If desired, the panel includes a rigid trigger extension that is pulled when it is desired to discharge fluid. Moreover, the non-deformable panel is limited to swinging movement about the hinge as the bellows section collapses and expands. Furthermore, the non-deformable panel does not distend during operation of the pump. Accordingly, the bellows section uniformly collapses and expands so as to provide consistent discharge amounts from one operation to another. The preferred bellows section comprises a plurality of pleats projecting from the hinge so that the bellows section arcuately expands and collapses. This further facilitates the discharge of consistent amounts of fluid from one operation to another.

The boss and panel preferably include inner faces that complementally engage one another when the bellows section is collapsed. The pleats of the bellows section stack one on top of another when the bellows section is collapsed to cooperatively present an inner stack boundary. Moreover, the boss projects into the chamber and presents an outer surface that conforms generally to the inner stack boundary so that the fluid chamber is substantially evacuated when the bellows section is collapsed. As previously indicated, evacuation of the fluid chamber will prevent air from becoming trapped therein so as to improve pump efficiency and to reduce the risk of "spitting".

The base, panel, hinge and bellows section preferably form a unitary body that is integrally molded of a plastic material, such as polypropylene. Further, the unitary body is formed of the same material as the other dispenser components to facilitate recycling.

If desired, the pump may include a spring operatively coupled with the panel to yieldably bias the panel away from the base for assisting with expansion of the bellows section. This construction is particularly useful when dispensing viscous fluids.

Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein.

DETAILED DESCRIPTION OF THE PREFERRED EMBODIMENTS

Figure 1:
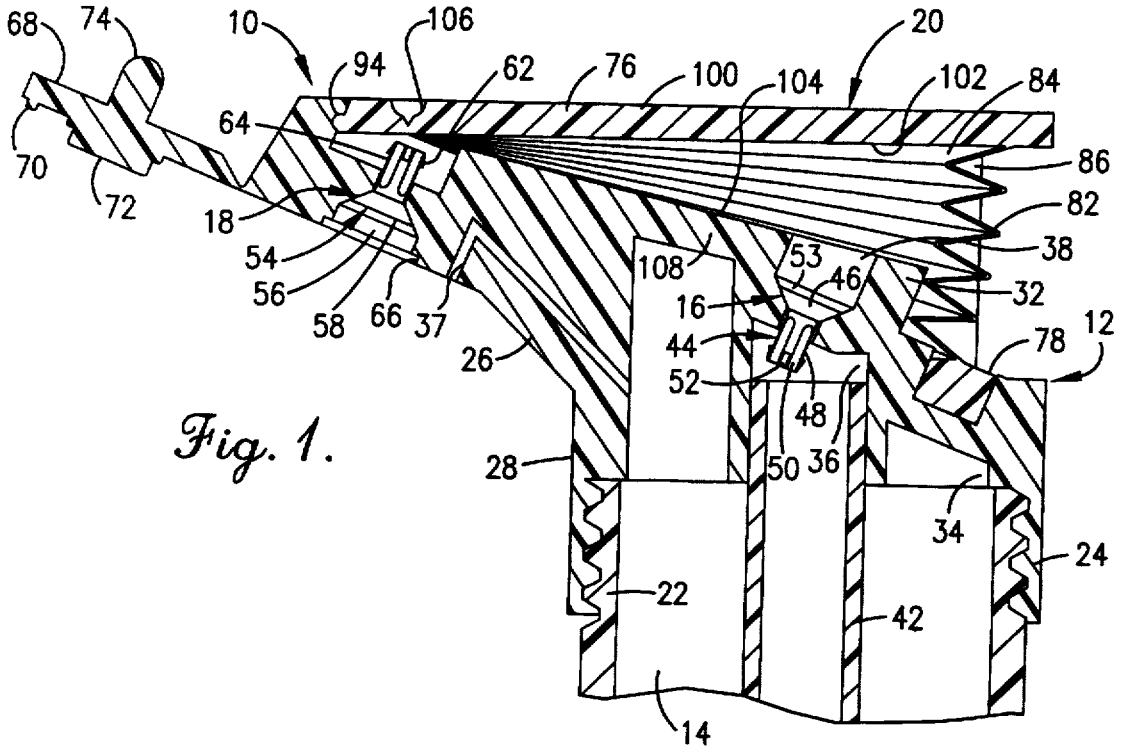
FIG. 1 is a fragmentary, vertical sectional view of a fluid dispenser including a pump constructed in accordance with the principals of the present invention, particularly illustrating the pump in a rest condition and the supply and discharge valves closed.

Turning initially to FIG. 1, the fluid dispenser 10 selected for illustration generally includes a dispensing head 12 removably secured to a container 14 containing a desired liquid. Pressure-responsive supply and discharge valves 16 and 18, respectively, are spaced along the fluid path extending through the dispensing head 12 for controlling fluid flow therethrough. The dispenser 10 further includes a pump 20 constructed in accordance with the principals of the present invention. As will be described further below, the pump 20 defines the fluid path between the supply and discharge valves 16 and 18, and causes fluid to be dispensed from the container 14 when depressed by the user. It will be appreciated that the principals of the present invention are equally applicable to other variously constructed fluid dispensers, and therefore, the dispensing head 12, container 14 and valves 16,18 should be used for illustrative purposes only.

With the foregoing caveat in mind, the container 14 has an externally threaded neck 22 that is releasably secured to the internally threaded base 24 of the dispensing head 12. The dispensing head 12 and container 14 are preferably formed of the same material, such as polypropylene, for facilitating recycling of the dispenser 10 (i.e., separation of the head 12 from the container 14 before recycling is unnecessary). Accordingly, the dispensing head 12 may be manufactured using the relatively inexpensive injection mold process, although production of the container 14 will most likely be limited a blow-mold process. The container 14 may take virtually any shape or size, however, a practical and attractive design is preferred. For example, the container 14 may have an outer surface that conforms to the shape of the users hand when the dispenser is gripped during operation.

The dispensing head 12 includes a nose 26 projecting forwardly from the base 24 at a slightly upwardly extending angle. As perhaps best shown in FIG. 4, the base 24 and nose 26 cooperatively define an outer surface 28 of the head that is substantially cylindrical about the base and trapezoidal about the nose 26. Additionally, the base 24 and nose 26 cooperatively define an upwardly and rearwardly open, wedge-shaped recess 30 that receives the pump 20. A boss 32 projecting upwardly from the floor of the recess 30 cooperates with the pump 20 to substantially evacuate the pump when operated, as will be further described hereinbelow.

Figure 7:
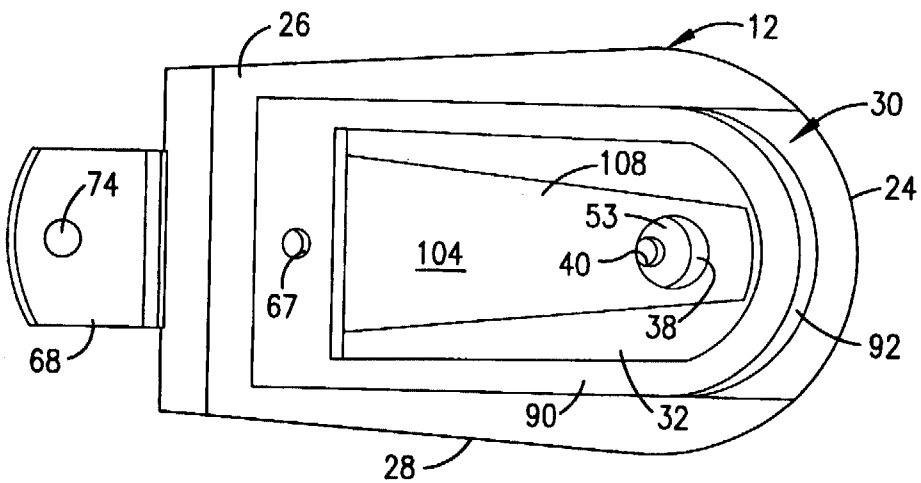
FIG. 7 is a top plan view of the dispenser body, particularly illustrating the boss.

The base 24 of the dispensing head 12 includes a downwardly opening annular cavity 34 and central cavity 36, with the annular cavity 34 being provided primarily to reduce the amount of material required to form the head 12. To accommodate the recess 30, the annular cavity 34 tapers (i.e., is shorter) along the rear boundary of the dispensing head 12. The dispensing head 12 includes a vent line 37 extending through the nose 26 and into the annular cavity 24 for allowing the container 14 to breathe in the usual manner. A relatively short conduit 38 defined in the boss 32 communicates with the central cavity 36 via an opening 40 (see FIG. 7). A tube 42 is sealingly received within the central cavity 36 for supplying fluid from the container 14 to the dispensing head 12. The tube 42 extends downwardly into the container 14 and presents a lower open end (not shown) that is spaced slightly from the bottom wall (not shown) of the container 14. Accordingly, the central cavity 36, conduit 38, opening 40 and tube 42 define the portion of the fluid path extending from the container 14 into the pump 20.

Figure 2:
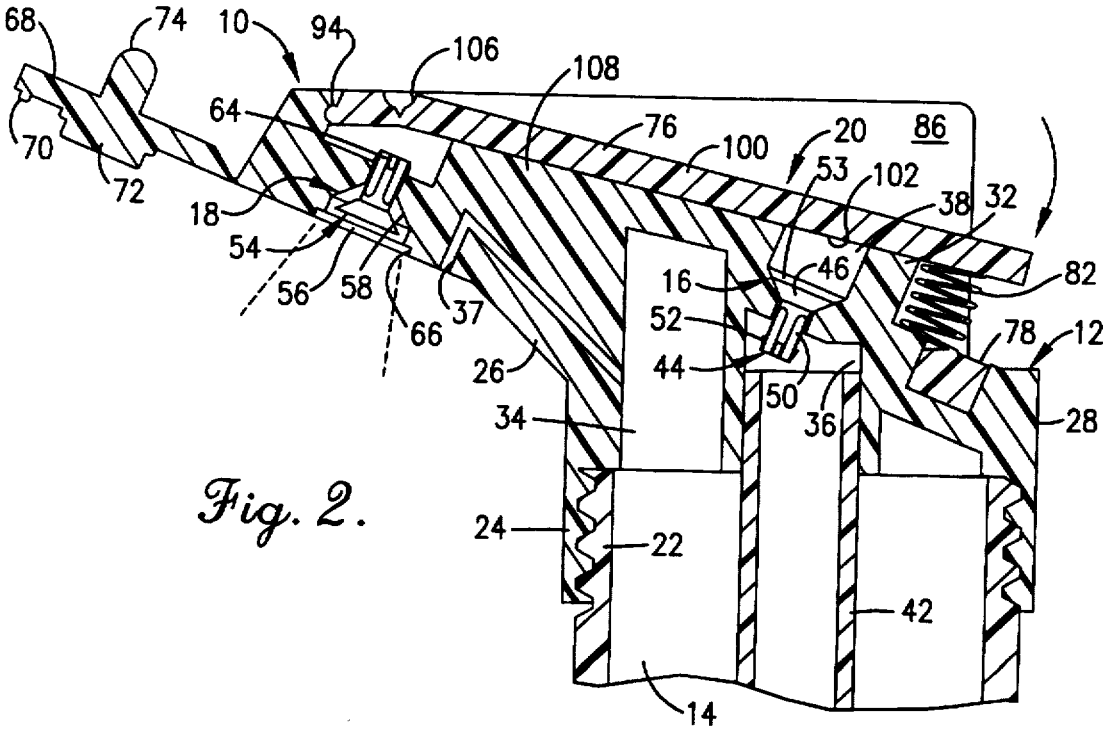
FIG. 2 is a fragmentary, vertical sectional view of the fluid dispenser shown in FIG. 1, but illustrating the pump in a discharge condition with the top panel of the pump swung downwardly into engagement with the boss, the supply valve closed, and the discharge valve open.
Figure 3:
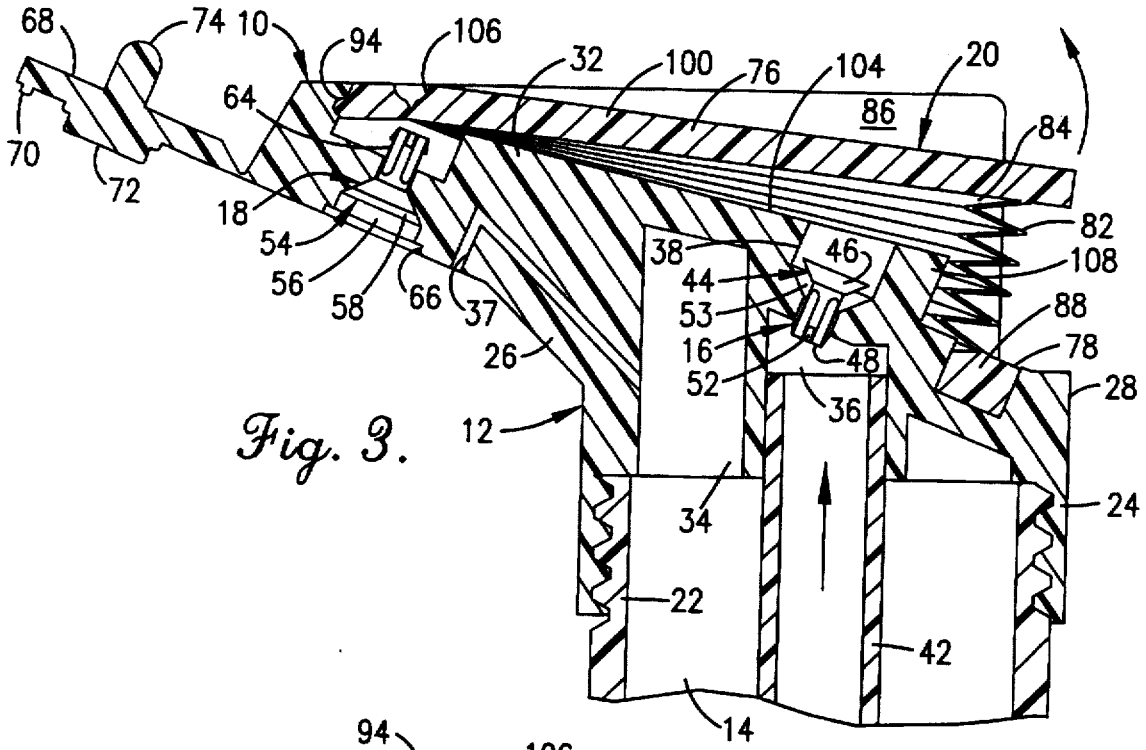
FIG. 3 is a fragmentary, vertical sectional view of the fluid dispenser shown in FIG. 1, but illustrating the pump in a recharging condition with the bellows section resiliently expanding to swing the top panel upwardly, the supply valve open and the discharged valve closed.

The supply valve 16 includes a seal member 44 shiftably disposed within the conduit 38. The seal member 44 includes a frustoconically-shaped crown 46 and a stem 48 having a plurality of circumferentially spaced, longitudinally extending grooves 50. At the tip of the stem 48 are a plurality of stop tabs 52 provided on the ridges defined between the grooves 50. A frustoconically-shaped portion 53 of the wall defining the conduit 38 forms a valve seat for sealingly engaging the crown 46 when the member is shifted downwardly into a valve-closed position (see FIGS. 1–2). When the crown 46 is unseated from the wall portion 53, fluid is allowed to flow upwardly through the conduit 38 around the stem 48 and through the grooves 50 (see FIG. 3). The stop tabs 52 prevent upward movement of the seal member 44 beyond the valve-open position shown in FIG. 3. As will be described below, the seal member 44 shifts between its valve-open and valve-closed positions in response to the pressure within the pump 20.

The supply valve 16 and discharge valve 18 are similar in construction and operate in generally the same manner. It is sufficient to explain, therefore, that the discharge valve 18 includes a seal member 54 shiftably disposed within a conduit 56 defined in the nose 26. A valve seat 58 is defined along the conduit 56 for sealingly engaging the crown 60 of the seal member 54 when the member is in its valve-closed position (see FIGS. 1 and 3). The seal member 54 similarly includes stop tabs 62 at the tip of the stem 64 for preventing downward movement beyond the valve-open position shown in FIG. 2. The conduit 56 opens downwardly to define a fluid outlet 66, while an opening 67 is defined in the floor of the recess 30 adjacent the upper end of the conduit 56 for intercommunicating the pump 20 and the conduit 56. Accordingly, the conduit 56 and the opening 67 define the portion of the fluid path extending from the pump 20 to the fluid outlet 66.

The dispensing head 12 includes a cap 68 for covering the fluid outlet 66 and vent line 37 SO that the dispenser 10 may be stored without risk of fluid leakage. The cap 68 is preferably integrally molded with the base 24 and nose 26 of the dispensing head 12, although a removable cap or other constructional variations are entirely within the ambit of the present invention. The cap 68 is swingably attached to the forwardmost tip of the nose 26 by a relatively thin, flexible segment of material. The cap 68 includes a first plug portion 70 configured for reception within the end of the vent line 37 and a second plug portion 72 configured for reception within the fluid outlet 66. When the cap 68 is swung in a counterclockwise direction into a plugging position (not shown), the plug portions 70 and 72 are received within the vent line 37 and fluid outlet 66, respectively, and thereby serve to close off the vent line and fluid outlet. A pull tab 74 projects from the opposite side of the cap 68 to facilitate pulling of the cap 68 from its plugging position.

Pump 20

Figure 4:
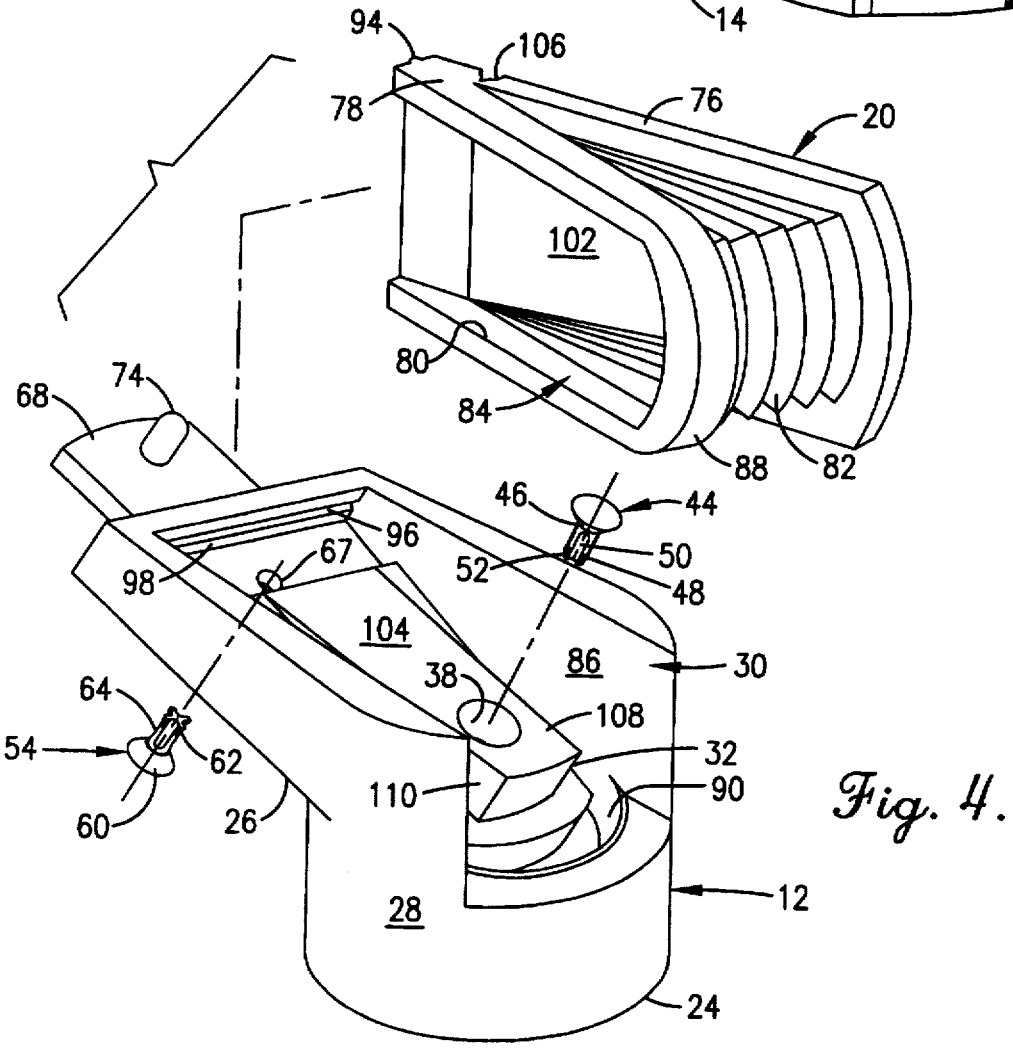
FIG. 4 is an exploded perspective view of the fluid dispenser shown in FIG. 1.

As perhaps best shown in FIG. 4, the pump 20 generally includes a relatively non-deformable panel 76, a base 78 presenting a chamber opening 80, and an arcuately collapsible bellows section 82 extending between the panel 76 and the base 78. The panel 76, base 78 and bellows section 82 cooperatively define a fluid chamber 84 which, in the illustrated embodiment, forms the portion of the fluid path extending between the supply valve 16 and discharge valve 18. Further, the panel 76, base 78 and bellows section 82 are preferably integrally formed to define a unitary body. The preferred pump body is formed of the same material (e.g., polypropylene) as the dispensing head 12 and container 14 to facilitate recycling. Further, as will be indicated below, the pump 20 is constructed in a manner that is conducive to formation by a relatively inexpensive injection mold process.

Generally speaking, the pump 20 substantially conforms to the shape of the recess 30 defined by the base 24 and nose 26 of the dispensing head 12. In this respect, the pump 20 fits between the interior sidewalls 86 (only one of the sidewalls being shown in the drawings) defining the recess 30, and has a rounded rearmost margin. The base 78 includes a relatively non-deformable flange 88 extending along the sides and the rounded rear boundary of the chamber opening 80. A channel 90 cooperatively defined between the boss 32 and the interior sidewalls 86 and interior rear wall 92 of the dispensing head 12 snugly receives the flange 88 SO that the boss 32 is sealingly received within the chamber opening 80. A rib 94 extending along the front side of the base 78 is snap-fit within a groove 96 (see FIG. 4) defined in the front interior wall 98 of the dispensing head 12 for providing positive connection between the head 12 and the pump 20 and for providing a seal therebetween.

The panel 76 presents an upper face 100 that lies generally flush with the top of the dispensing head 12 when the pump is in a rest condition (see FIG. 1). Because of the rigidity of the panel 76, the upper face 100 forms the firing surface that is pressed by user when it is desired to dispense fluid, although a separate firing member or trigger for exerting a force against the upper face 100 may be used. The panel 76 also presents a lower, inner face 102 that complementally engages the upper, inner face 104 of the boss 32 when the pump is in a discharge condition (see FIG. 2). Preferably, the faces 102 and 104 are flat, however, the principals of the present invention are equally applicable to other mating configurations. The pump includes a hinge 106 adjacent the forward end of the panel 76 for limiting the panel 76 to swinging movement relative to the base 78. The illustrated hinge 106 comprises a transverse notch defined between the base 78 and the upper face 100 of the panel 76, wherein the notch has a generally semicircular shape with a small radial projection extending toward the fluid chamber 84.

Figure 6:
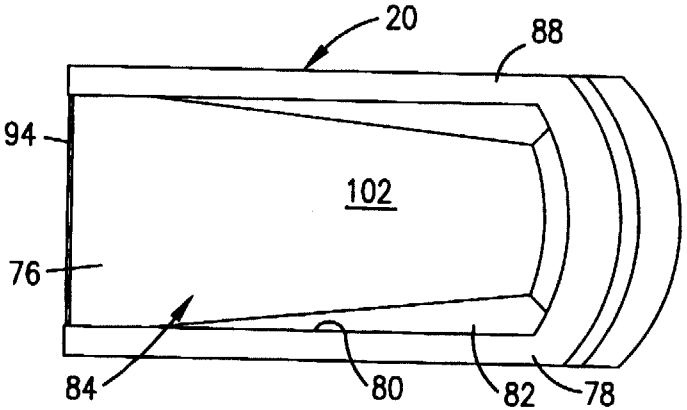
FIG. 6 is a bottom plan view of the pump shown in FIGS. 1–4.

The illustrated bellows section 82 comprises a plurality of pleats projecting generally from the hinge 106 such that the bellows section 82 is arcuately collapsible and expandable, although other bellows arrangements may be provided between the panel 76 and base 78. As perhaps best shown in FIG. 6, the pleats have a generally trapezoidal shape with a rounded rear edge. Further, when the panel 76 is swung toward the base 78 into complemental engagement with the boss 32, the pleats stack one on top of another to form an inner stack boundary having a trapezoidal shape with a rounded rear margin, when viewed from the top, and a generally triangular or wedge-shaped profile (viewed from the side). The boss 32 includes an upper portion 108 presenting an outer surface 110 that conforms generally to the inner stack boundary. That is, the outer surface 110 has a trapezoidal shape with a rounded rear portion, when viewed from the top (see FIG. 7), and a triangular profile (see FIG. 4). Accordingly, when the pump 20 is in the discharge condition (see FIG. 2), the upper portion 108 of the boss 32 occupies substantially the entire collapsed fluid chamber for ensuring complete evacuation of the pump.

Operation

The operation of the dispenser 10 should be apparent from the foregoing description. Thus, suffice it to explain that the pump 20 must initially be charged with fluid before dispensing occurs. Accordingly, the cap 68 is pulled from the underside of the nose 26 to uncover the vent line 37 and the fluid outlet 66. The upper face 100 of the panel 76 is then pressed downwardly toward the base 78 to collapse the bellows section 82, whereby the pressure in the fluid chamber 84 increases. Such positive pressure within the fluid chamber 84 seats the seal member 44 against the wall portion 53 to close the supply valve 16, and unseats the seal member 54 from the wall portion 58 to open the discharge valve 18. Air within the fluid chamber 84 is thereby expelled through the fluid outlet 66. When the panel 76 is released, the bellows section 82 resiliently expands, causing the panel 76 to swing upwardly away from the base 78 and thereby expansion of the fluid chamber 66. Accordingly, negative pressure created within the expanding fluid chamber 66 opens the supply valve 16 and closes the discharge valve 18 so that fluid is draw into the chamber from the container 14 (see FIG. 3). It will be appreciated that in conventional mechanical dispensers these steps must be repeated several times before the pump is completely charged. However, with the present invention, because the fluid chamber 66 is substantially evacuated when the pump 20 is placed in the discharge condition (see FIG. 2), the panel 76 need only be pressed once to completely charge the pump 20. Of course, additional pump operations may be required if air is trapped within the fluid path extending from the container 14 into the chamber 66.

Once the pump is charged, each subsequent depression of the panel 76 causes discharge of fluid. Further, the amount of fluid discharged with each subsequent pump operation is consistent. The consistent discharge amounts may be attributed to several factors. For example, the panel 76 is non-deformable so that swelling or flexing of the panel 76 is eliminated (i.e., variations in the volume of the fluid chamber 76 are minimized). Further, movement of the panel 76 is limited to swinging about the hinge 106 so that side-to-side "slop" of the panel is eliminated. Yet further, the pleats of the bellows section 82 collapse uniformly when the panel 76 is swung toward the base 78. This action is further facilitated by the fact that the pleats of the bellows section 82 project generally from the hinge 106 so that the bellows section arcuately collapses and expands about the hinge 106.

Figure 8:
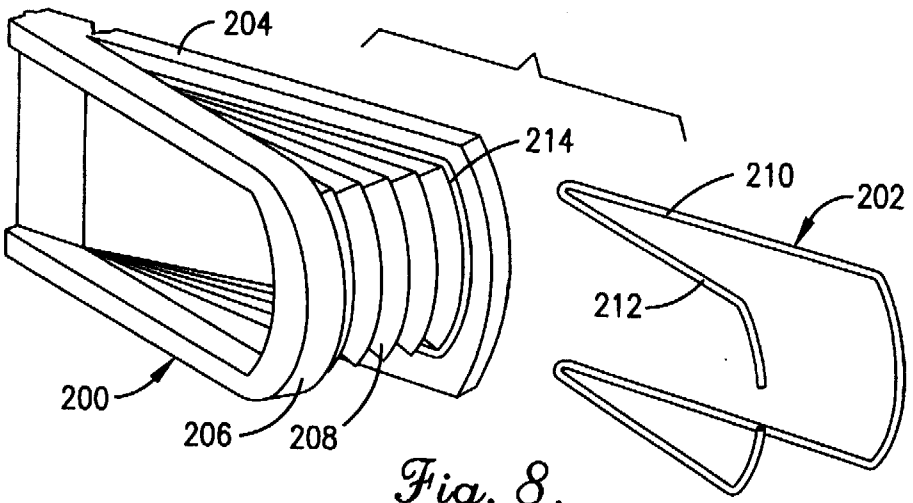
FIG. 8 is an exploded perspective view of an alternative embodiment of the pump, particularly illustrating an auxiliary spring coupled with the pump for yieldably biasing the top panel away from the base to assist with expansion of the bellows section.
Figure 5:
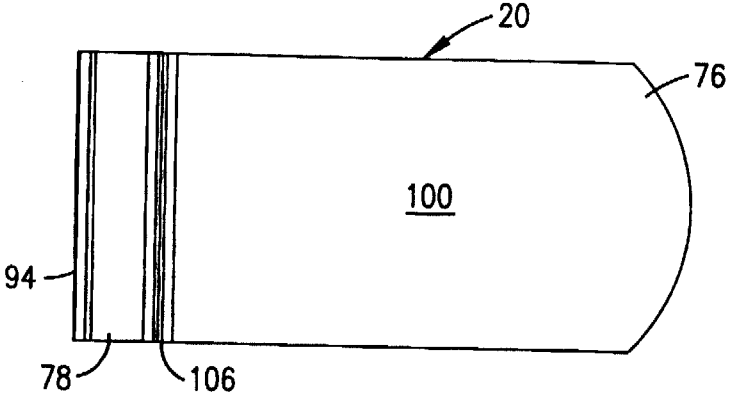
FIG. 5 is a top plan view of the pump shown in FIGS. 1–4.
Figure 9:
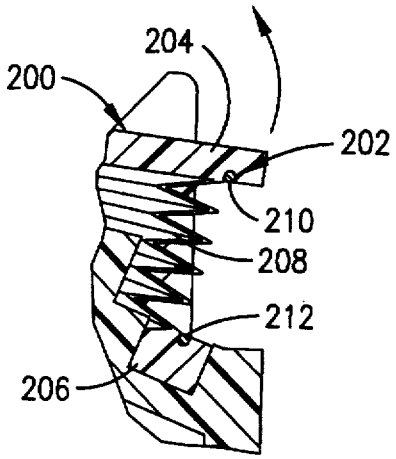
FIG. 9 is a fragmentary, vertical sectional view of a fluid dispenser having the pump shown in FIG. 8, particularly illustrating the top panel being swung away from the base by the bellows section and spring.

As shown in FIGS. 8–9, the pump 200 may alternatively be constructed to include an auxiliary spring 202 for yieldably biasing the panel 206 away from the base 208. The bias of the spring 202 is particularly helpful when viscous fluids are dispensed and/or when the bellows section lacks sufficient resiliency to return the panel to the rest condition. Particularly, the spring comprises a pair of U-shaped elements 210 and 212 cooperatively forming a joint from which the elements diverge. The element 212 is broken along its bight to reduce twisting of the spring 202 during operation. A pair of oppositely facing grooves 214 defined in the panel 206 and the base 208 (only the groove in the panel 206 is shown in FIG. 8) receive the spring sections 210 and 212 (see also FIG. 9).

Figure 10:
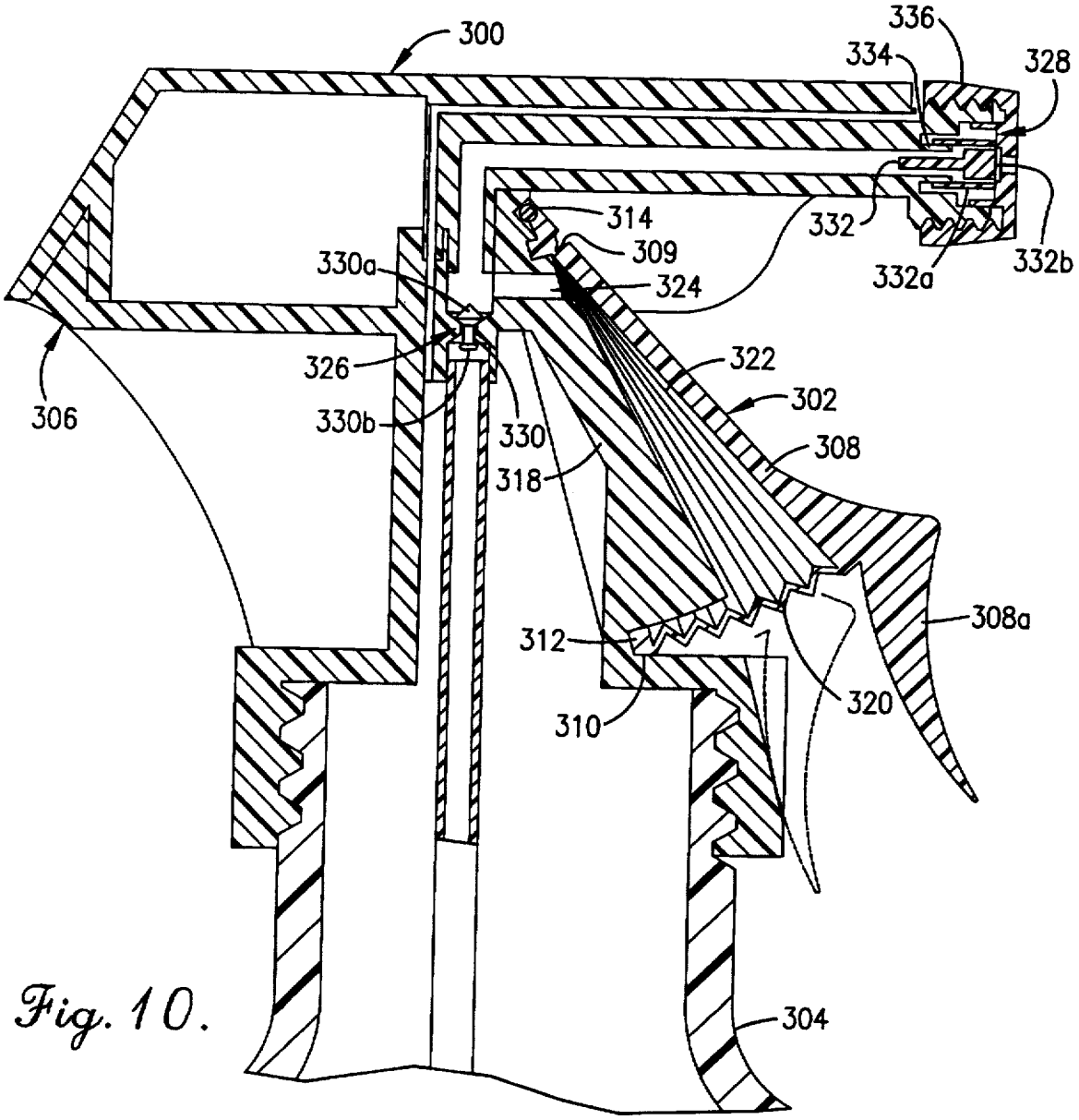
FIG. 10 is a fragmentary, vertical sectional view of yet another embodiment of the present invention, particularly illustrating a pump constructed in accordance with the principals of the present invention employed on trigger sprayer, with the top panel including a trigger extension that is pulled when it is desired to discharge fluid.

Another embodiment of the present invention is shown in FIG. 10 as comprising a trigger sprayer 300 including a pump 302 constructed in accordance with the principals of the present invention, a container 304, and a dispensing head 306 threadably secured to the container 304. The relatively non-deformable panel 308 of the pump 302 includes a rigid trigger extension **308*a* that is pulled by the user when it is desired to dispense fluid. Similar to the previously described embodiment, movement of the panel 308 is limited by a hinge 309. The base 310 of the pump 302 includes a flange 312 surrounding the chamber opening, and a pair of outwardly projecting posts 314 (only one being shown) snap-fit within grooves defined in the dispensing head 306. The panel 308 and the boss 318 have inner faces that complementally engage when the bellows section 320 is collapsed. Further, the boss 318 projects into the fluid chamber 322 and presents an outer surface that conforms generally to the inner stack boundary of the bellows section 320. A conduit 324 extends through the boss 318 to associate the fluid chamber 322** with the fluid path.

The trigger sprayer 300 further includes an alternatively constructed supply valve 326 and discharge valve 328. The supply valve 326 comprises a seal member 330 shiftably disposed within the dispensing head 306, wherein the member 330 includes tip **330*a* that seats against the conduit, and a stop rib 330*b* for limiting upward movement of the member 330. The discharge valve 328, on the other hand, comprises a shiftable seal member 332 having a ring 332*a* and a solid core 332*b* interconnected by a plurality of circumferentially spaced spokes (not shown). The ring 332*a* slides along the conduit 334, while the core 332*b* seats against the end of the conduit 334 when the valve 328 is closed. The dispensing head 306 includes a threaded cap 336 defining the fluid outlet, wherein the cap 336 may be screwed down to secure the valve 328 in the closed position (note, the discharge valve 328 is shown in the open position). The supply and discharge valves 326 and 328 open and close responsive to the pressure created within the fluid chamber 322** in the same manner noted above.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention. That is, the principals of the present invention are equally applicable to constructional variations other than those noted above. For example, the pump may be formed integrally with the dispensing head, rather than forming the pump as a separate part assembled with the head. Further, the hinge of the pump may have configurations other than those illustrated herein, such as a transverse notch defined along the inner face of the panel. If desired, the supply and discharge valves may likewise be constructed differently than the various constructions illustrated herein.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. In a fluid dispenser having a container, an outlet, a fluid path extending between the container and outlet, and pressure-responsive supply and discharge valves spaced along the path for controlling fluid flow therethrough, the improvement comprising:

a pump defining a fluid chamber and including a generally non-deformable panel, a hinge about which the panel swings, and a hollow bellows section projecting from the panel and comprising a plurality of pleats that protect from the hinge such that the bellows section is arcuately collapsible and expandable, said fluid chamber being associated with the fluid path between the supply and discharge valves, said bellows section uniformly collapsing when the panel is swung in a first direction about the hinge, whereby positive pressure created within the chamber closes the supply valve and opens the discharge valve for discharging fluid through the outlet, and resiliently expanding when the panel swings in an opposite second direction about the hinge whereby negative pressure created within the chamber opens the supply valve and closes the discharge valve for inducing fluid flow from the container into the chamber.

2. In a fluid dispenser as claimed in claim 1, said pump including a base presenting a chamber opening, said bellows section extending between the base and the panel such that the panel swings toward the base in said first direction and away from the base in said second direction.

3. In a fluid dispenser as claimed in claim 2, and a boss sealingly received within the chamber opening, with the fluid path extending through the boss and into the chamber.

4. In a fluid dispenser as claimed in claim 3, said boss and said panel including inner faces that complementally engage one another when the bellows section is collapsed.

5. In a fluid dispenser as claimed in claim 4, said pleats stacking one on top of another when the bellows section is collapsed to cooperatively present an inner stack boundary, said boss projecting into the chamber and presenting an outer surface that conforms generally to the inner stack boundary so that the fluid chamber is substantially evacuated when the bellows section is collapsed.

6. In a fluid dispenser as claimed in claim 5, said inner faces of the boss portion and the panel being flat.

7. In a fluid dispenser as claimed in claim 6, said base, panel and bellows section forming a unitary body.

8. In a fluid dispenser as claimed in claim 7, said body being formed of a molded plastic material.

9. In a fluid dispenser as claimed in claim 1, said panel including a rigid trigger extension that is pulled when it is desired to discharge fluid.

10. In a fluid dispenser as claimed in claim 1, said panel and bellows section being integrally molded of a plastic material.

11. In a fluid dispenser as claimed in claim 1, said bellows section comprising a plurality of pleats projecting from the hinge so that the bellows section arcuately collapses and expands.

12. In a fluid dispenser as claimed in claim 1, said pump including a spring operatively coupled with the panel for yieldably biasing the panel in said second direction.

13. In a fluid dispenser having a container, an outlet, a fluid path extending between the container and outlet, and pressure-responsive supply and discharge valves spaced along the path for controlling fluid flow therethrough, the improvement comprising:

a pump defining a fluid chamber and including a generally non-deformable panel, a hinge about which the panel swings, and a hollow, collapsible bellows section projecting from the panel, said fluid chamber being associated with the fluid path between the supply and discharge valves, said bellows section uniformly collapsing when the panel is swung in a first direction about the hinge, whereby positive pressure created within the chamber closes the supply valve and opens the discharge valve for discharging fluid through the outlet, and resiliently expanding when the panel swings in an opposite second direction about the hinge whereby negative pressure created within the chamber opens the supply valve and closes the discharge valve for inducing fluid flow from the container into the chamber, said pump including a base presenting a chamber opening, said bellows section extending between the base and the panel such that the panel swings toward the base in said first direction and away from the base in said second direction, a boss sealingly received within the chamber opening, with the fluid path extending through the boss and into the chamber, said boss and said panel including inner faces that complementally engage one another when the bellows section is collapsed, said bellows section comprising a plurality of pleats that stack one on top of another when the bellows section is collapsed to cooperatively present an inner stack boundary, said boss projecting into the chamber and presenting an outer surface that conforms generally to the inner stack boundary so that the fluid chamber is substantially evacuated when the bellows section is collapsed, said inner faces of the boss portion and the panel being flat, said base, panel and bellows section forming a unitary body, said pleats projecting from the hinge so that the bellows section arcuately collapses and expands, said hinge comprising a notch defined in the body adjacent an end of the panel.

14. In a fluid dispenser as claimed in claim 13, said base including a generally non-deformable flange extending partly around the opening.

15. In a fluid dispenser as claimed in claim 14, said pump including a spring operatively coupled with the panel for yieldably biasing the panel in said second direction.

16. In a fluid dispenser as claimed in claim 15, said spring comprising a pair of elements cooperatively forming a joint from which the elements diverge, said panel and said base each including a groove receiving one of the spring elements, with the joint being disposed adjacent the hinge.

17. In a fluid dispenser having a container, an outlet, a fluid path extending between the container and outlet, and pressure-responsive supply and discharge valves spaced along the path for controlling fluid flow therethrough, the improvement comprising:

a pump defining a fluid chamber and including a generally non-deformable panel, a hinge about which the panel swings, and a hollow, collapsible bellows section projecting from the panel, said fluid chamber being associated with the fluid path between the supply and discharge valves, said bellows section uniformly collapsing when the panel is swung in a first direction about the hinge, whereby positive pressure created within the chamber closes the supply valve and opens the discharge valve for discharging fluid through the outlet, and resiliently expanding when the panel swings in an opposite second direction about the hinge whereby negative pressure created within the chamber opens the supply valve and closes the discharge valve for inducing fluid flow from the container into the chamber, said hinge comprising a notch defined in the pump adjacent an end of the panel.

18. In fluid dispenser having a container, an outlet, a fluid path extending between the container and outlet, and pressure-responsive supply and discharge valves spaced along the path for controlling fluid flow therethrough, the improvement comprising:

a pump defining a fluid chamber and including a base presenting a chamber opening, a generally non-deformable panel moveable relative to the base, and a hollow, collapsible bellows section extending between the panel and the base; and a boss sealingly received within the chamber opening, with the fluid path extending through the boss and into the chamber between the supply and discharge valves, said bellows section collapsing when the panel is moved toward the base, whereby positive pressure created within the chamber closes the supply valve and opens the discharge valve for discharging fluid through the outlet, and expanding when the panel moves away from the base, whereby negative pressure created within the chamber opens the supply valve and closes the discharge valve for inducing fluid flow from the container into the chamber, said boss and said panel including inner faces that complementally engage one another when the bellows section is collapsed, said bellows section comprising a plurality of pleats that stack one on top of another when the bellows section is collapsed to cooperatively present an inner stack boundary, said boss projecting into the chamber and presenting an outer surface that conforms generally to the inner stack boundary so that the fluid chamber is substantially evacuated when the bellows section is collapsed.

19. In a fluid dispenser as claimed in claim 18, said inner faces of the boss portion and the panel being flat.

20. In a fluid dispenser as claimed in claim 19, said base, panel and bellows section forming a unitary body.

21. In a fluid dispenser as claimed in claim 20, said body being formed of a molded plastic material.

22. In a fluid dispenser as claimed in claim 20, said pump including a hinge about which the panel swings relative to the base.

23. In a fluid dispenser as claimed in claim 22, said pleats projecting from the hinge so that the bellows section arcuately collapses and expands.

24. In a fluid dispenser as claimed in claim 18, said panel including a rigid trigger extension that is pulled when it is desired to discharge fluid.

25. In a fluid dispenser as claimed in claim 18, said base, panel and bellows section forming a unitary body.

26. In a fluid dispenser as claimed in claim 18, said pump including a hinge about which the panel swings relative to the base.

27. In a fluid dispenser as claimed in claim 26, said bellows section comprising a plurality of pleats projecting from the hinge so that the bellows section arcuately collapses and expands.

28. In a fluid dispenser as claimed in claim 18, said pump including a spring operatively coupled with the panel for yieldably biasing the panel away from the base.

29. In a fluid dispenser having a container, an outlet, a fluid path extending between the container and outlet, and pressure-responsive supply and discharge valves spaced along the path for controlling fluid flow therethrough, the improvement comprising:

a pump defining a fluid chamber and including a base presenting a chamber opening, a generally non-deformable panel moveable relative to the base, and a hollow, collapsible bellows section extending between the panel and the base; and a boss sealingly received within the chamber opening, with the fluid path extending through the boss and into the chamber between the supply and discharge valves, said bellows section collapsing when the panel is moved toward the base, whereby positive pressure created within the chamber closes the supply valve and opens the discharge valve for discharging fluid through the outlet, and expanding when the panel moves away from the base, whereby negative pressure created within the chamber opens the supply valve and closes the discharge valve for inducing fluid flow from the container into the chamber, said pump including a hinge about which the panel swings relative to the base, said hinge comprising a notch defined in the pump adjacent an end of the panel.

30. In a fluid dispenser having a container, an outlet, a fluid passageway extending between the container and outlet, and pressure-responsive supply and discharge valves spaced along the passageway for controlling fluid flow therethrough, the improvement comprising:

a pump defining a fluid chamber and including a base presenting a chamber opening, a generally non-deformable panel moveable relative to the base, and a hollow, collapsible bellows section extending between the panel and the base; and a boss sealingly received within the chamber opening, with the fluid path extending through the boss and into the chamber between the supply and discharge valves, said bellows section collapsing when the panel is moved toward the base, whereby positive pressure created within the chamber closes the supply valve and opens the discharge valve for discharging fluid through the outlet, and expanding when the panel moves away from the base, whereby negative pressure created within the chamber opens the supply valve and closes the discharge valve for inducing fluid flow from the container into the chamber, said pump including a spring operatively coupled with the panel for yieldably biasing the panel away from the base, said spring comprising a pair of elements cooperatively forming a joint from which the elements diverge, said panel and said base each including a groove receiving one of the spring elements.

31. A pump for use in a fluid dispenser, said pump comprising:

a body defining a fluid chamber and including, a base, a generally non-deformable panel, a hinge about which the panel swings relative to the base, and a hollow, collapsible bellows section extending between the base and the panel, said bellows section uniformly collapsing when the panel is moved toward the base, and resiliently expanding when the panel is released, said body being integrally molded of a plastic material, said hinge comprising a notch defined in the body adjacent an end of the panel.

32. A pump as claimed in claim 31, said bellows section comprising a plurality of pleats the hinge so that the bellows section arcuately collapses and expands.

33. A pump as claimed in claim 32, said panel presenting a flat inner face.

34. A pump as claimed in claim 32, said panel including a rigid trigger extension adjacent an opposite end thereof.

35. A pump as claimed in claim 32, said base including a generally non-deformable flange extending partly around the opening.

36. A pump as claimed in claim 32, said pump including a spring operatively coupled with the panel for yieldably biasing the panel away from the base.

37. A pump as claimed in claim 36, said spring comprising a pair of elements cooperatively forming a joint from which the elements diverge, said panel and said base each including a groove receiving one of the spring elements, with the joint being disposed adjacent the hinge.

* * * * *